US011724164B2

(12) United States Patent
Scott et al.

(10) Patent No.: US 11,724,164 B2
(45) Date of Patent: Aug. 15, 2023

(54) SMART GOLF CLUBHEAD

(71) Applicant: Philip Andrew Scott, Sanctuary Cove (AU)

(72) Inventors: Philip Andrew Scott, Sanctuary Cove (AU); Fatiha Sahnoune, Sanctuary Cove (AU)

(73) Assignee: Philip Andrew Scott, Sanctuary Cove (AU)

( * ) Notice: Subject to any disclaimer, the term of this patent is extended or adjusted under 35 U.S.C. 154(b) by 0 days.

(21) Appl. No.: 17/244,836

(22) Filed: Apr. 29, 2021

(65) Prior Publication Data

US 2021/0339100 A1 Nov. 4, 2021

Related U.S. Application Data

(63) Continuation-in-part of application No. 29/736,553, filed on Jun. 1, 2020.

(60) Provisional application No. 63/017,264, filed on Apr. 29, 2020.

(51) Int. Cl.

| | |
|---|---|
| ***A63B 53/08*** | (2015.01) |
| ***A63B 53/06*** | (2015.01) |
| ***A63B 53/04*** | (2015.01) |

(52) U.S. Cl.

CPC ..... *A63B 53/08* (2013.01); *A63B 53/0433* (2020.08); *A63B 53/06* (2013.01); *A63B 2209/14* (2013.01)

(58) Field of Classification Search

CPC ..... A63B 53/08; A63B 53/06; A63B 2209/14; A63B 53/007; A63B 53/065; A63B 53/0487; A63B 2053/0491; A63B 53/04; A63B 53/0437; A63B 53/0433

USPC ..... 473/324–350, 287–292, 313; D21/733–736

See application file for complete search history.

(56) References Cited

U.S. PATENT DOCUMENTS

| | | | | | |
|---|---|---|---|---|---|
| D58,209 | S | * | 6/1921 | Bacheller | D21/745 |
| 2,954,231 | A | * | 9/1960 | MacIntyre | A63B 53/0487 473/251 |
| 2,957,696 | A | * | 10/1960 | Warpotas | A63B 53/007 473/251 |
| 3,143,349 | A | * | 8/1964 | MacIntyre | A63B 53/0487 473/338 |
| 3,448,981 | A | * | 6/1969 | Anweiler | A63B 53/007 473/314 |
| 3,459,426 | A | * | 8/1969 | Sherwood | A63B 53/007 473/201 |
| D234,962 | S | * | 4/1975 | Swash | 473/340 |

(Continued)

*Primary Examiner* — Sebastiano Passaniti

(74) *Attorney, Agent, or Firm* — Pilloff Passing & Cosenza LLP; Sean A. Passing; Rachel K. Pilloff

(57) ABSTRACT

A golf clubhead that is designed with a unique inner and outer structure, using geometry and technology to provide super symmetry, harmony and balance at motion and at rest of golf swings. The triangular form clubhead does not require compensation during the swing thus allowing for greater repetition and simplicity of movement in turn producing performance benefits via consistency. The geometric triangular shape of the clubhead provides an instantly recognizable assistance in proper alignment at the rest position. The body of the clubhead may be hollow and feature inner symmetrical structures to complement the form of the body and to enhance and provide superior weight distribution and balance.

3 Claims, 9 Drawing Sheets

(56) References Cited

U.S. PATENT DOCUMENTS 3,966,210 A * 6/1976 Rozmus ..... A63B 53/0487 473/341
4,712,798 A * 12/1987 Preato ..... A63B 69/3685 473/239
5,082,277 A * 1/1992 Gingold ..... A63B 53/0487 473/250
5,186,465 A * 2/1993 Chorne ..... A63B 60/00 473/350
5,344,151 A * 9/1994 Anderson ..... A63B 60/02 473/337
5,620,379 A * 4/1997 Borys ..... A63B 53/04 473/313
D434,819 S * 12/2000 Hoare ..... D21/736
6,244,974 B1 * 6/2001 Hanberry, Jr. ..... A63B 53/007 473/242
6,267,689 B1 * 7/2001 Ambrose ..... A63B 60/42 473/251
6,767,293 B2 * 7/2004 Pechter ..... A63B 53/02 473/313
6,929,559 B1 * 8/2005 Grace ..... A63B 53/0487 473/251
6,958,019 B2 * 10/2005 Rohrer ..... A63B 60/02 473/251
7,140,974 B2 * 11/2006 Chao ..... A63B 60/00 473/329
7,186,190 B1 * 3/2007 Beach ..... A63B 60/00 473/335
D543,252 S * 5/2007 Haggstrom ..... D21/736
7,255,653 B2 * 8/2007 Saso ..... A63B 53/0466 473/345
7,347,793 B2 * 3/2008 Davis ..... A63B 60/02 473/305
7,371,184 B2 * 5/2008 Tao ..... A63B 53/0487 473/242
7,491,131 B2 * 2/2009 Vinton ..... A63B 60/02 473/251
7,753,809 B2 * 7/2010 Cackett ..... A63B 53/0466 473/345
7,867,104 B2 * 1/2011 Franklin ..... A63B 53/0487 473/251
8,303,434 B1 * 11/2012 DePaul ..... A63B 53/0487 473/341
8,353,782 B1 * 1/2013 Beach ..... A63B 60/02 473/329
9,433,834 B2 * 9/2016 Stites ..... A63B 53/04
9,604,108 B1 * 3/2017 Dunnell ..... A63B 60/02
2002/0151374 A1 * 10/2002 Imamura ..... A63B 53/0487 473/236
2003/0232661 A1 * 12/2003 Greer, Jr. ..... A63B 53/0487 473/340
2006/0189409 A1 * 8/2006 Krumme ..... A63B 53/047 473/342
2008/0248893 A1 * 10/2008 Davis ..... A63B 60/42 473/340
2014/0024473 A1 * 1/2014 Reid ..... A63B 53/007 473/313
2017/0136322 A1 * 5/2017 Green ..... A63B 60/42

* cited by examiner

SMART GOLF CLUBHEAD

The current application claims a priority to the U.S. Provisional Patent application Ser. No. 63/017,264 filed on Apr. 29, 2020 and a priority to the U.S. Design patent application Ser. No. 29/736,553 filed on Jun. 1, 2020.

FIELD OF THE INVENTION

The present invention generally relates to golf clubs. More specifically, the present invention relates to golf clubheads that provides super symmetrical balance and energy to help a user reduce and/or eliminate undesired rotation of the club head at any point or plane during the swing, including at motion and at rest.

BACKGROUND OF THE INVENTION

A golf club designed to improve performance is in demand. Golfers at all skill levels are always seeking to improve their performance, and golf equipment manufacturers have responded to their demands. As a result, golf club design has evolved from wooden golf club heads to titanium alloy clubheads and more.

Initially, golf club manufacturers focused on aesthetically pleasing designs, so that today a wide array of models are available, including some golf club head designs that have been designed to improve performance. The aim of such golf clubhead designs is to make the club head easier to hit, including by increasing the size of the clubhead and clubface.

To allow a player's skill to develop, the design of the golf club must change to allow better performance, but it can be difficult to manufacture clubs suited to the various player characteristics. Furthermore, current clubs are not well balanced and require significant compensation during the swing at achieve a constant ball flight, a skill that requires constant practice that is not available to most golfers. Accordingly, there is a need to develop a golf club and associated technology that can solve this problem.

The present invention is intended to address problems associated with and/or otherwise improve on conventional devices through an innovative smart golf club designed to provide an optimized super symmetry, balance, and alignment, while incorporating other problem-solving features.

SUMMARY OF THE INVENTION

The present invention provides a unique and innovative smart clubhead specifically designed through a balance technology, which incorporates super symmetrical balance and energy between the clubhead and the shaft of a golf club. The resulting clubhead reduces and/or eliminates undesired rotations of the clubhead at any point or plane of a golf swing, including in motion and at rest. The invention provides golf clubheads with perfect geometric balance and harmony both internally and externally. The smart clubhead designs and materials will dramatically reduce the need for compensation during use, therefore simplifying the input from the golfer and allowing for improvement. The smart clubhead includes a body, a club face, a hosel and inner technology. The body may be hollow with a cavity to accommodate the inner technology and other features to ensure optimal weight distribution and super symmetry of the clubhead. The smart clubhead is designed for use in various types of golf clubs, including, but not limited to, drivers, fairway clubs, iron clubs, and hybrid clubs, etc., to provide a balanced weight distribution with an optimized balance for improved golfing performance of the user. Thus, the unique clubhead of the present invention provides a performance edge in terms of golf swing consistency and performance, and allows for repeatability in the action of the clubhead.

DETAIL DESCRIPTIONS OF THE INVENTION

All illustrations of the drawings are for the purpose of describing selected versions of the present invention and are not intended to limit the scope of the present invention.

The present invention provides a clubhead of a golf club, which is designed with a unique and innovative structure for optimized super symmetry, balance, and alignment to help a user achieve improved golf swing performance. The clubhead of the present invention may be used with an additional internal system that adjusts the weight distribution of the golf club to reduce and/or eliminate undesired rotations of the clubhead at any point or plane of a golf swing, including in motion and at rest. Thus, the clubhead provide a performance edge in terms of consistency and performance and allows for repeatability in the action of the club head.

Figure 1:
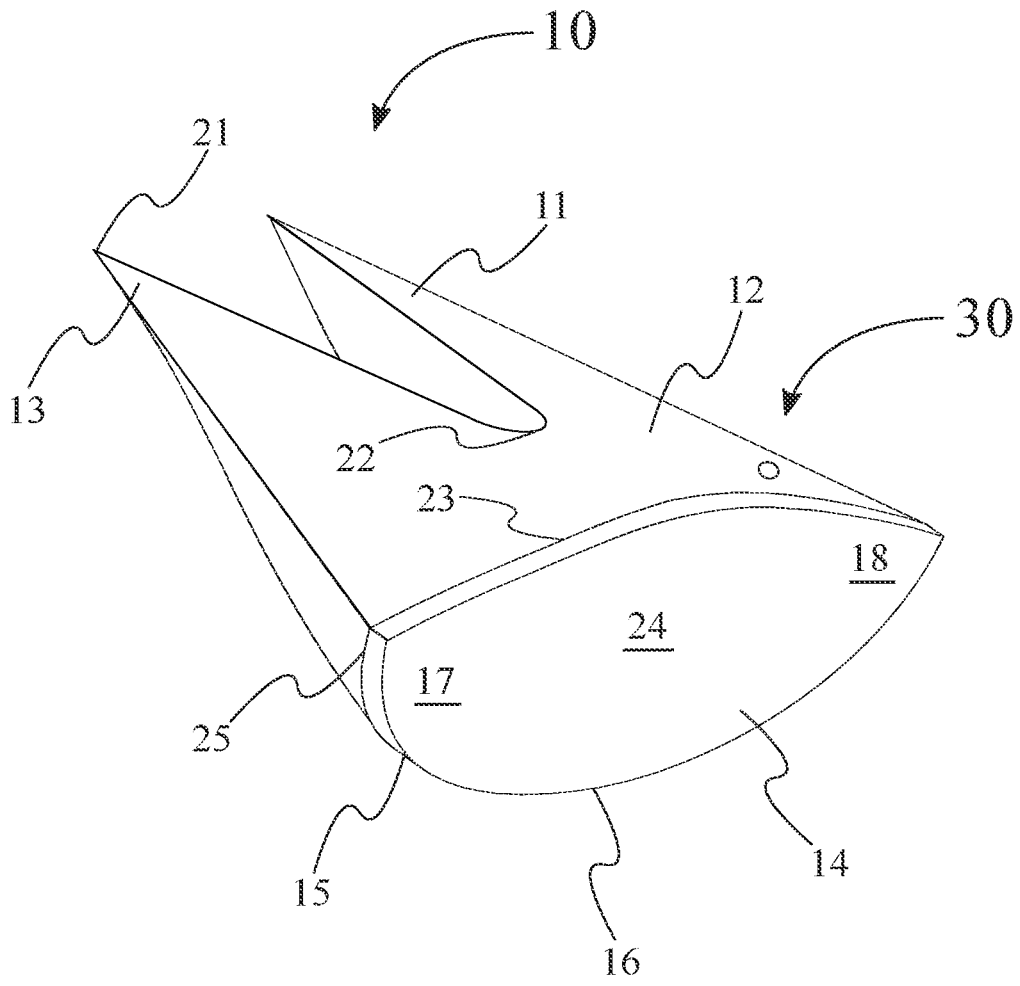
FIG. 1 is a perspective view of one embodiment of the present invention with two triangular members.
Figure 2:
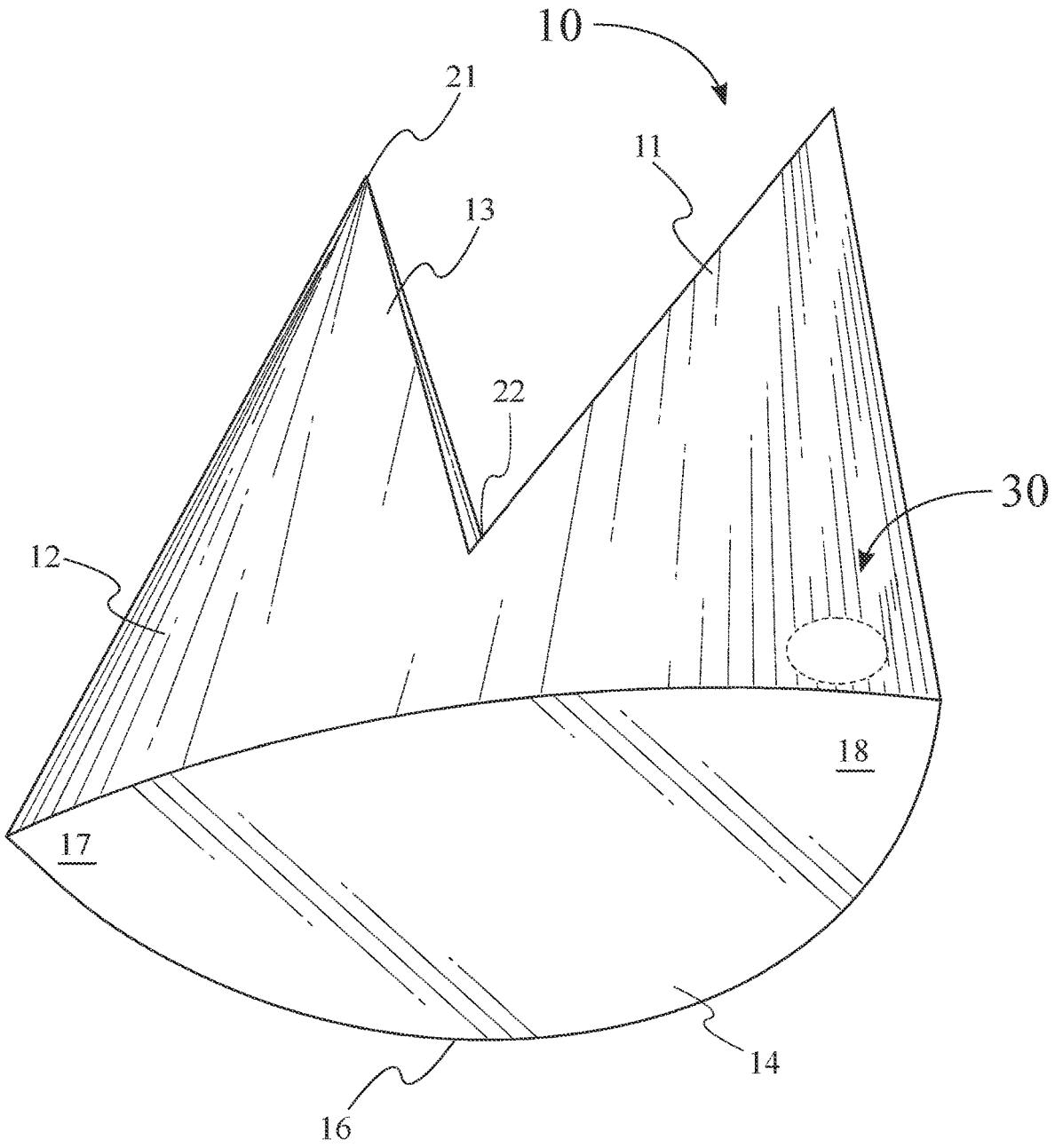
FIG. 2 is a front-perspective view of the embodiment of the present invention with two triangular members.
Figure 3:
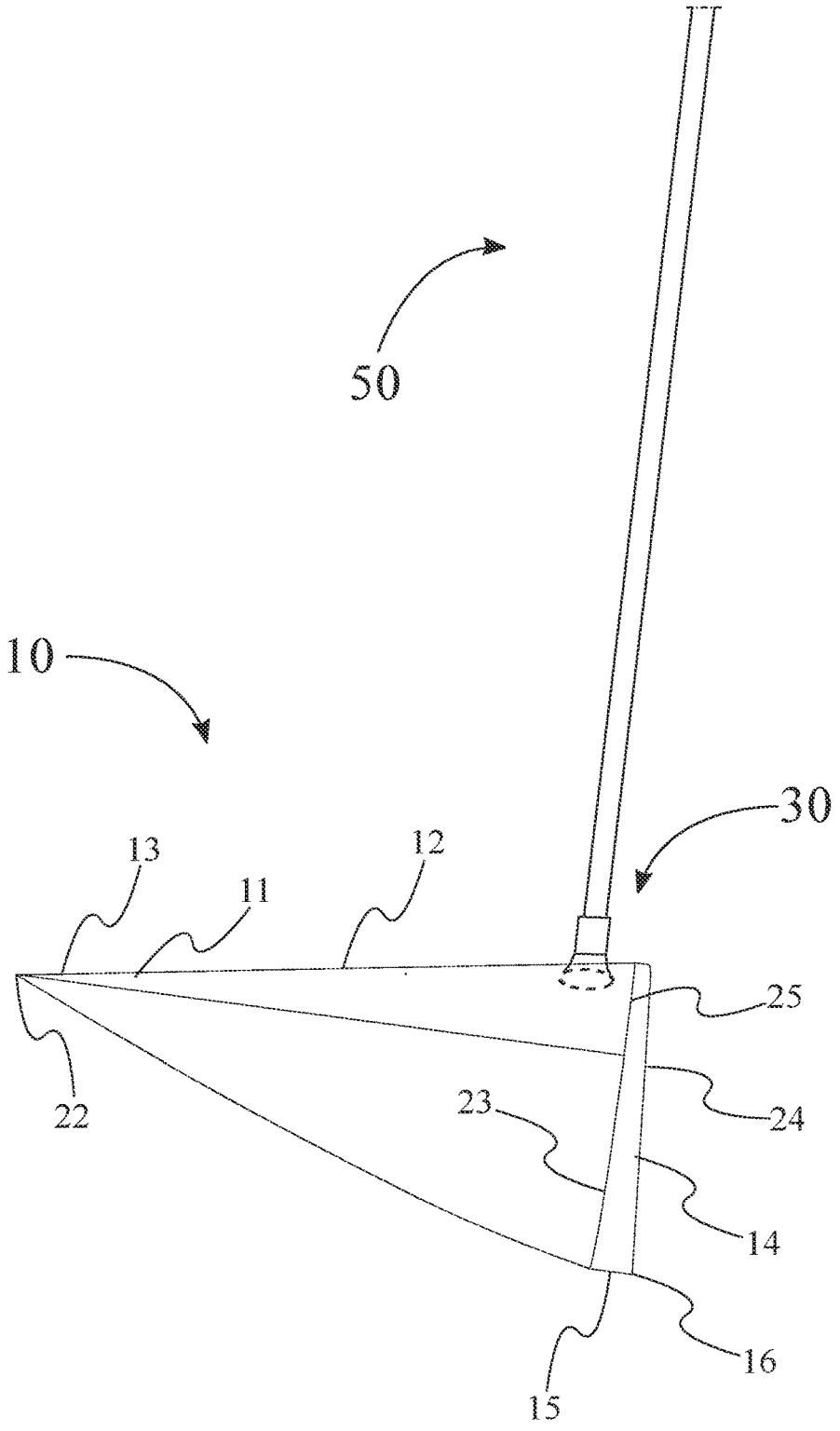
FIG. 3 is a side view of the embodiment of the present invention with two triangular members and a shaft.
Figure 4:
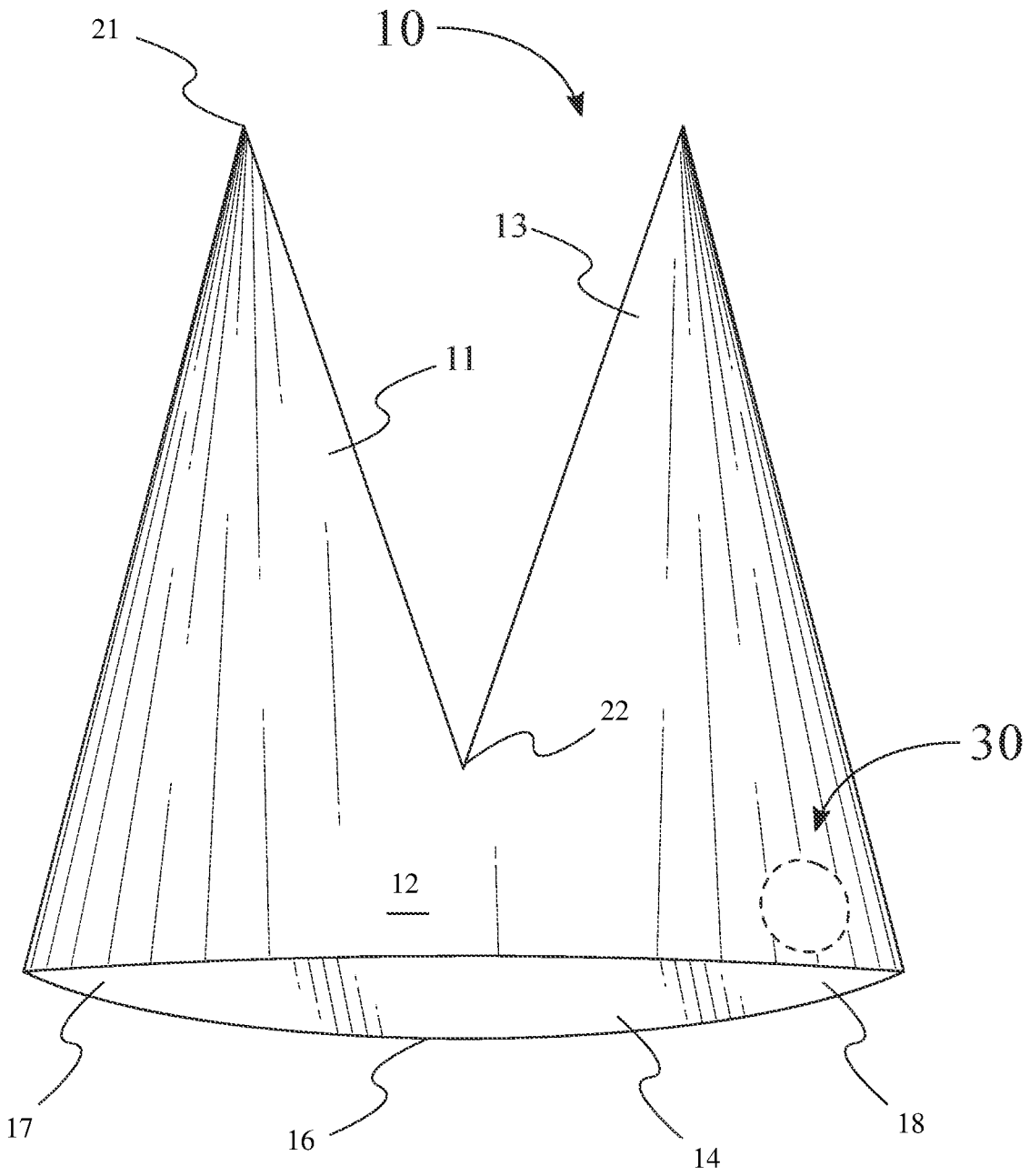
FIG. 4 is a front view of the embodiment of the present invention with two triangular members.
Figure 5:
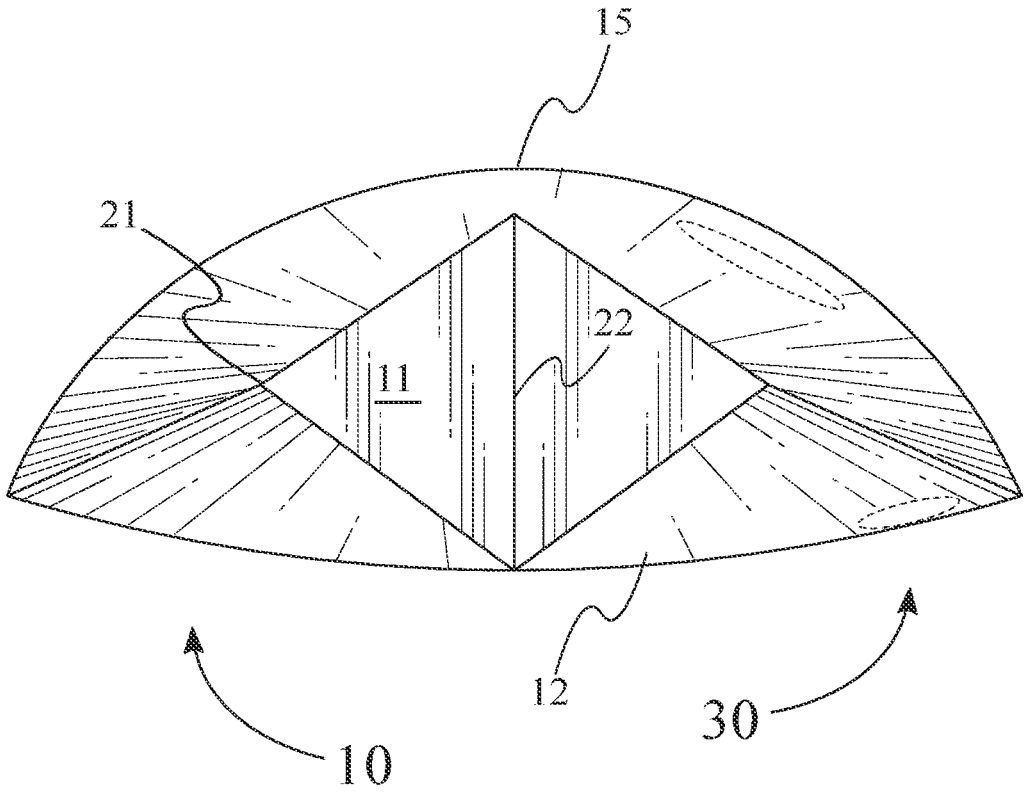
FIG. 5 is a rear view of the embodiment of the present invention with two triangular members.
Figure 6:
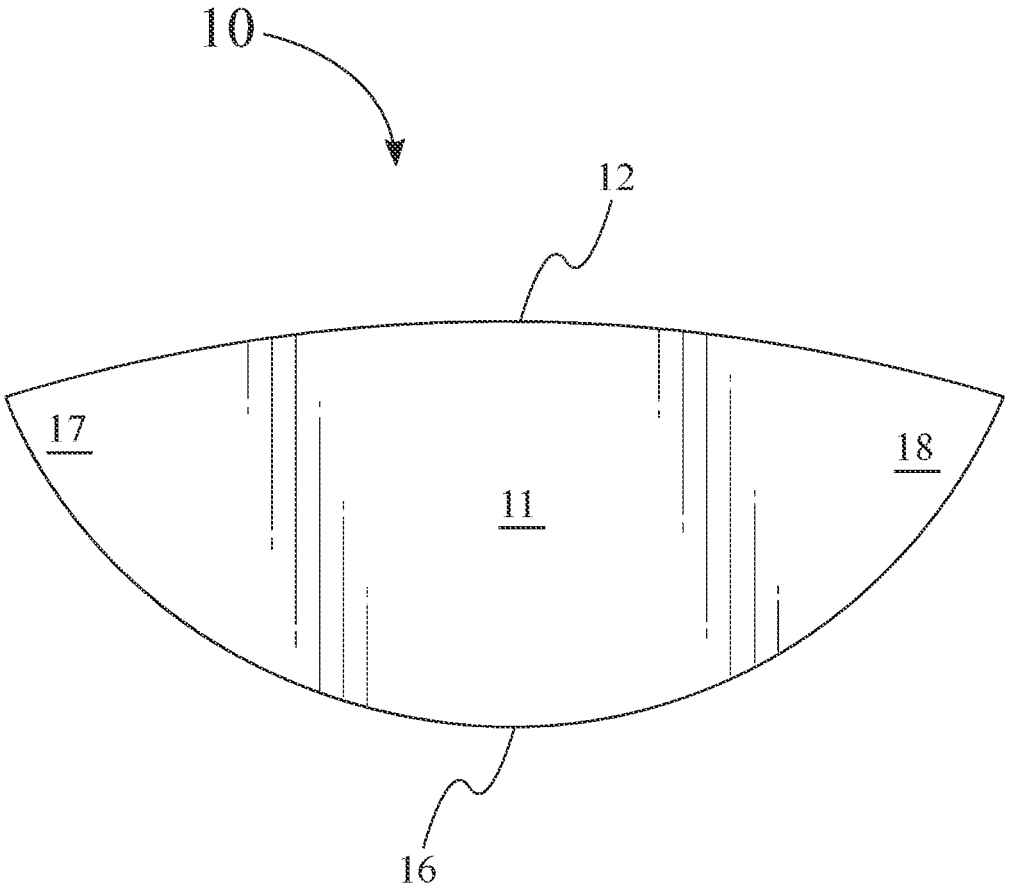
FIG. 6 is a front view of the embodiment of the present invention with two triangular members.
Figure 7:
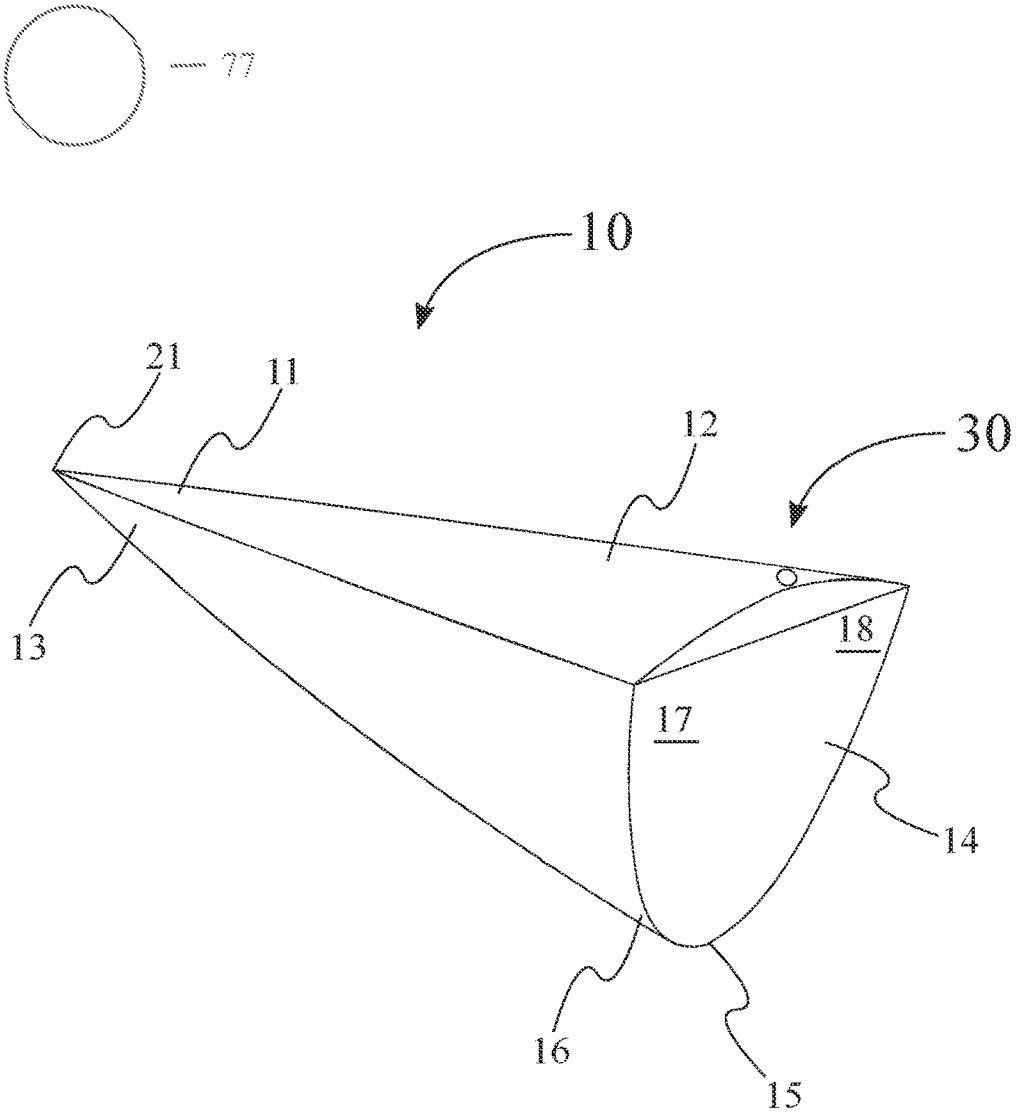
FIG. 7 is a perspective view of an alternative embodiment of the present invention with one triangular member.
Figure 8:
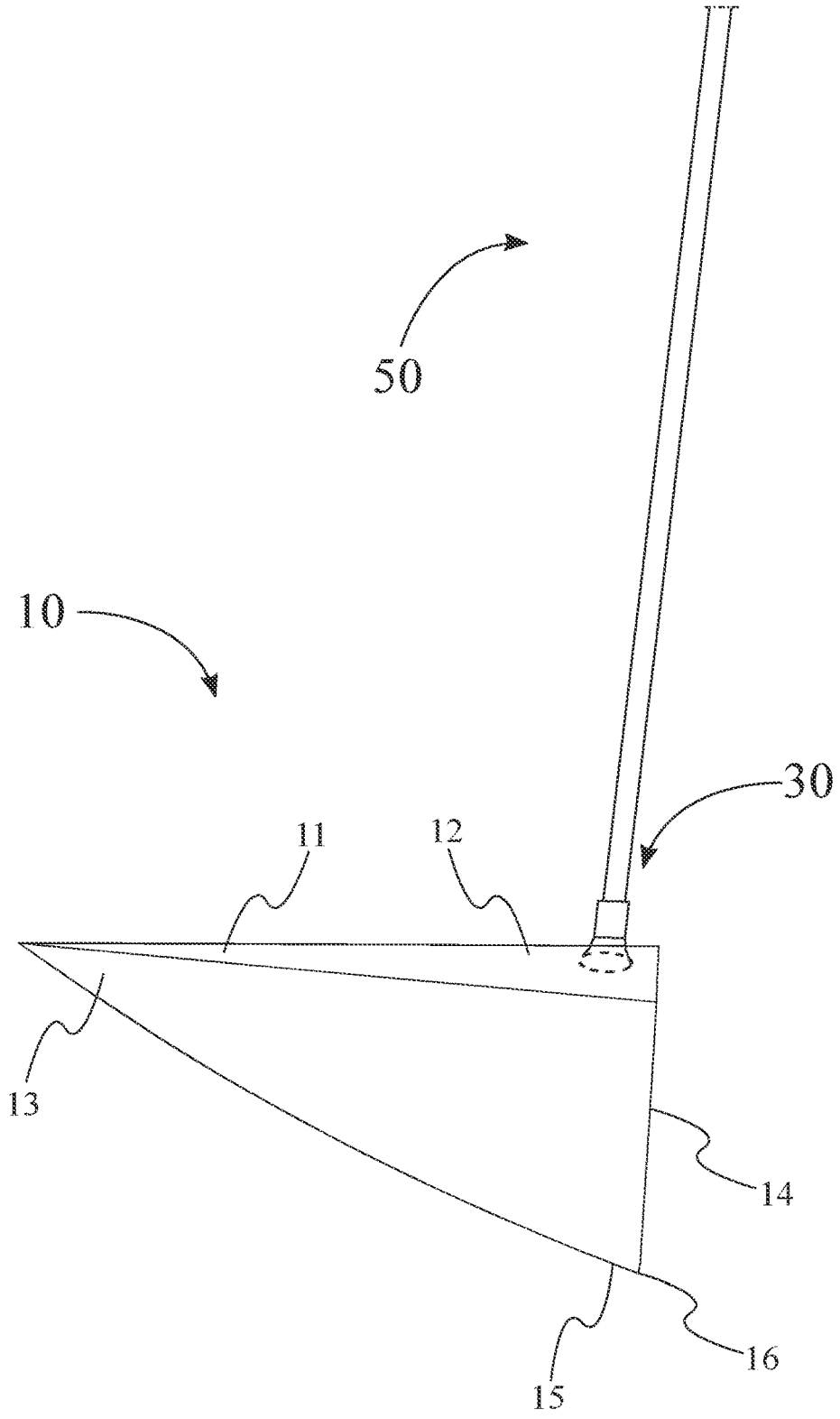
FIG. 8 is a side view of the alternative embodiment of the present invention with one triangular member.

As can be seen in FIG. 1 to FIG. 9, the present invention offers a unique and innovative golf clubhead designed for use in various types of golf clubs, including, but not limited to, drivers, fairway clubs, iron clubs, and hybrid clubs, etc., to provide a super symmetrical balance of the clubhead for improved golfing performance of the user. The clubhead of the present invention may be used with an additional internal system that adjusts the weight distribution of the golf club. Specifically, the clubhead of the present invention comprises a triangular body 10, a hosel 30, which connects the clubhead to a shaft 50 extraneous to the present invention, as can be seen in FIG. 3 and FIG. 8. The triangular body 10 may at any point be smoothed to produce a smoother edge without losing its inherent triangular shape. The triangular body 10 comprises at least one triangular member 11, a crown 12, a clubface 14 including opposite ends 17 and 18, a sole 15, and a leading edge 16. The clubface 14 comprises a front 24 and a back 25. Being a hitting face, the front 24 of the clubface 14 can be of any suitable shape, including, but not limited to, a semicircular form with the back 25 of the clubface 14 attached to the crown 14 so that the bottom of the triangular member 11 may have a substantially rounded shape. The at least one triangular member 11 comprises an apex 21, an aft end 13, and a base face 23. More specifically, the apex 21 is terminally positioned on the aft end 13, which is distally positioned on the at least one triangular member 11 opposite to the base face 23. The aft end 13 comprises at least one predetermined balance weight which may be incorporated into the aft end 13 of the at least one triangular member 11 permanently or movably, thus allowing position and/or location adjustments of the at least predetermined balance weight to achieve a super symmetrical balance of the clubhead for improved golfing performance of the clubhead. The clubface 14 of the triangular body 10 is attached to the base face 23 of the at least one triangular member 11. The crown 12 is positioned on the triangular body 10 opposite the sole 15, of which the leading edge 16 is positioned at the intersection with the clubface 14. Further, the hosel 30 is positioned on the crown 12 of the triangular body 10 at a point offset from an apex of the upper edge of the clubface, as shown in FIG. 1.

Figure 9:
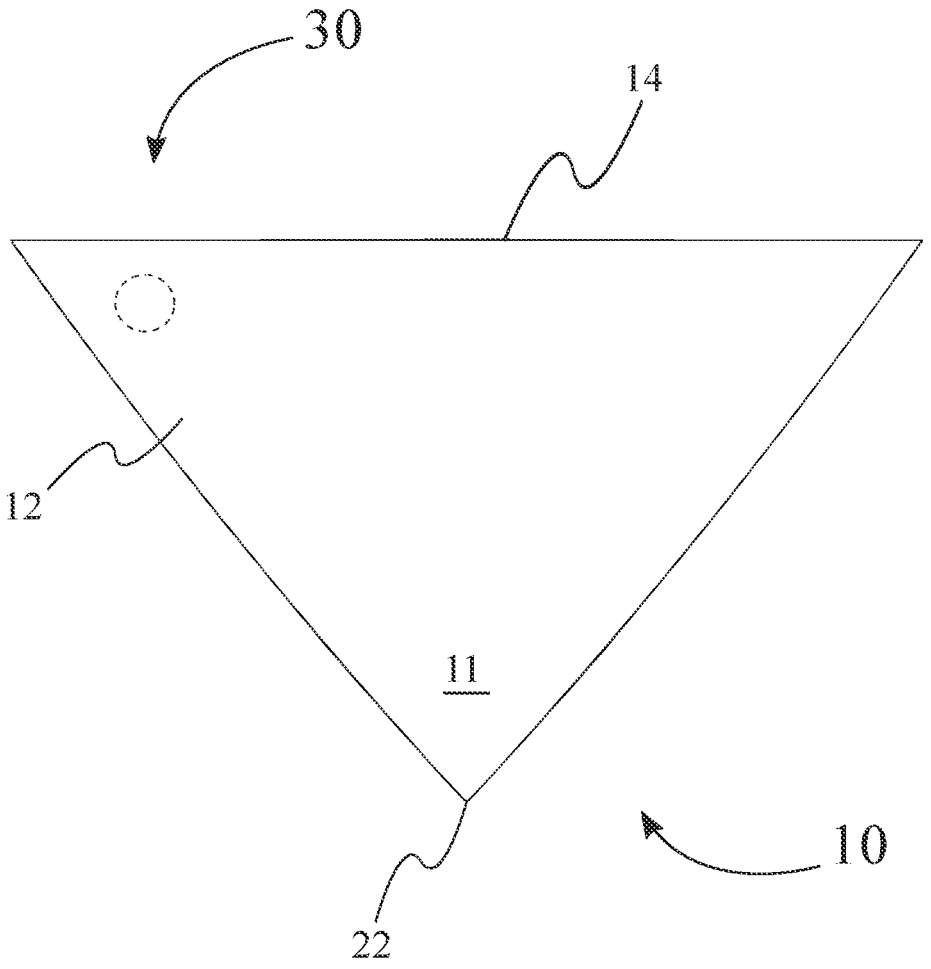
FIG. 9 is a top view of the alternative embodiment of the present invention with one triangular member.

As can be seen in FIG. 1 to FIG. 9, in the preferred embodiment of the present invention, the triangular member 11 has a shape that is substantially triangular with or without the corners being smoothed off. Additionally, the triangular member 11 may include a substantially triangular shape from the clubface 14 to the aft end 13, with the clubface 14 forming the base of the triangle and the aft end 13 forming the apex of the triangle. Further, the triangular member 11 may include a tapered or smoothed side going from the crown 14, which can be the top surface of the at least one triangular member 11 toward the sole 15 (bottom surface) of the at least one triangular member 11. The at least one triangular member 11 can be of any suitable size. In some embodiments, the dimensions of the at least one triangular member 11 may meet all the size limits required by the United States Golf Association (USGA). The shape of the at least one triangular member 11 of the clubhead allows significantly more weight to be placed on the aft end 13 opposite the hitting face 14, providing a super symmetrical balance of the clubhead for improved golfing performance and the positioning of the CG of the clubhead. In an alternative embodiment of the present invention, the at least one triangular member 11 comprises two triangular members, a vertex 22, and a base face 23. The two triangular members 11 are connected through the vertex 22 and the two triangular members 11 are interconnected with the base face 23. Additionally, the clubface 14 is attached to the two triangular members of the at least one triangular member 11 through the base face 23. Thus, the at least one triangular member 11 of the clubhead incorporates two triangular members connected at one vertex, the vertex 22, and is configured to form a common hitting face, the clubface 14 on one side of each triangular member to provide a balanced weight distribution and the super symmetrical balance of the clubhead for improved golfing performance. When viewed from the top, such an embodiment may include two apexes of the triangular members opposite the clubface 14, as can be seen in FIG. 1 to FIG. 2, FIG. 4 to FIG. 5, instead of one apex when only one triangular member is used to form the clubhead, as can be seen in FIG. 7, and FIG. 9.

FIG. 7 shows the aft end 13 comprises at least one predetermined balance weight 77 which may be incorporated into the aft end 13 of the at least one triangular member 11 permanently or movably, thus allowing position and/or location adjustments of the at least predetermined balance weight to achieve a super symmetrical balance of the clubhead for improved golfing performance of the clubhead.

In some embodiments of the present invention, the at least one triangular member 11 is hollow and may include a geometric pattern that creates an aesthetic balance, whereby the characteristics of the clubhead shall match the properties of the shaft that can be attached to the clubhead. In some embodiments, the hollow area inside the clubhead may be filled with various materials, including, but not limited to, Nitinol, Aerogel, and other shape-memory polymers such as Sorbothane, and any other suitable material. In some embodiments, the at least one triangular member 11 may comprise at least one predetermined balance weight. The at least one predetermined balance weight is movably and interiorly positioned in the at least one triangular member 11. In some other embodiments, the at least one triangular member 11 may comprise at least one internally-positioned symmetrical structure. In some embodiments, the at least one triangular member 11 may comprise a taper, which exteriorly traverses the triangular body 10 from the crown 12 to the sole 15.

In some embodiments, the at least one triangular member 11 of the triangular body 10 comprises at least one material including, but not limited to, smart material, memory shape material, thermoplastic materials, shape-memory metals (e.g., steel, titanium, and aluminum), copper, nickel, alloys of various materials, graphite, and treatments thereof, which may be deemed to assist in performance or presentation. Alternatively, at least one triangular member 11 of the clubhead may be made of a combination of one or more such materials. The materials may be in the form of a powder, liquid, foam, or in a solid state. The applications of such materials can include stripes, rings, and emulsion.

Although the invention has been explained in relation to its preferred embodiment, it is to be understood that many other possible modifications and variations can be made without departing from the spirit and scope of the invention as hereinafter claimed.

What is claimed is:

1. A clubhead for providing balance and energy between the clubhead and a golf shaft comprising:

a triangular body;

a hosel;

the triangular body comprising at least one triangular member; a crown, a clubface, and a sole;

the at least one triangular member comprising an apex, an aft end, a base face and a tapered or smoothed side going from the crown toward the sole;

the apex being terminally positioned on the aft end;

the aft end being distally positioned on the at least one triangular member opposite to the base face;

the aft end comprising at least one predetermined balance weight;

the clubface being attached to the base face of the at least one triangular member, wherein a bottom of the triangular member has a rounded shape and an upper edge of the clubface is curved;

the crown being positioned on the triangular body opposite the sole; and the hosel being positioned on the crown of the triangular body at a point offset from an apex of the upper edge of the clubface;

wherein the at least one triangular member comprising two triangular members; the two triangular members being connected through a vertex; the two triangular members being interconnected with the base face; and wherein the at least two triangular members are hollow.

2. The clubhead for providing balance and energy between the clubhead and a golf shaft as claimed in claim 1, wherein the at least two triangular members comprising at least one smart material.

3. A clubhead for providing balance and energy between the clubhead and a golf shaft comprising:

a triangular body;

a hosel;

the triangular body comprising at least one triangular member; a crown, a clubface, and a sole;

the at least one triangular member comprising an apex, an aft end, a base face and a tapered or smoothed side going from the crown toward the sole;

the apex being terminally positioned on the aft end;

the aft end being distally positioned on the at least one triangular member opposite to the base face;

the aft end comprising at least one predetermined balance weight;

the clubface being attached to the base face of the at least one triangular member, wherein a bottom of the triangular member has a rounded shape and an upper edge of the clubface is curved;

the crown being positioned on the triangular body opposite the sole; and the hosel being positioned on the crown of the triangular body at a point offset from an apex of the upper edge of the clubface;

wherein the at least one triangular member comprising two triangular members; the two triangular members being connected through a vertex; the two triangular members being interconnected with the base face;

wherein the at least two triangular members are hollow; and wherein the at least two triangular members comprising at least one memory shape material.

* * * * *